United States Patent [19]

James

[11] 4,185,830

[45] Jan. 29, 1980

[54] WORD PUZZLE GAME

[76] Inventor: David B. James, 431 Dawn Ave., Glen Ellyn, Ill. 60137

[21] Appl. No.: 903,902

[22] Filed: May 8, 1978

[51] Int. Cl.[2] ..... A63F 9/10

[52] U.S. Cl. ..... 273/157 R; 35/35 H; 273/153 R

[58] Field of Search ..... 273/153 R, 156, 157 R, 273/272; 35/35 R, 35 H, 35 J, 71

[56] References Cited

U.S. PATENT DOCUMENTS

| | | | |
|---|---|---|---|
| 1,383,097 | 6/1921 | Gibson | 273/156 X |
| 1,605,825 | 11/1926 | Fekete | 35/71 |
| 3,174,753 | 3/1965 | Miller | 273/157 R |
| 3,877,703 | 4/1975 | Pierre | 273/272 |

FOREIGN PATENT DOCUMENTS

| | | | |
|---|---|---|---|
| 885340 | 12/1961 | United Kingdom | 273/272 |

OTHER PUBLICATIONS

Puzzle, Washington Daily News, Mar. 20, 1967, p. 52.

*Primary Examiner*—Anton O. Oechsle

*Attorney, Agent, or Firm*—Dressler, Goldsmith, Clement, Gordon & Shore, Ltd.

[57] ABSTRACT

A puzzle game apparatus and method of playing the game are disclosed wherein a base is provided with a plurality of rows of letters and punctuation symbols at fixed locations in the rows. A plurality of template outlines of various planar shapes and sizes are located in fixed positions among the letters and punctuation symbols in the rows. A plurality of movable elements corresponding in shape and size to various ones of the template outlines and adapted to be superimposed in registry thereon are provided. Each movable element has a letter display area which is identical in size and shape with the letter display areas of the other elements and which displays therein a letter. To play the game, the movable elements are arranged in predetermined locations on the base and are superimposed in registry on the various template outlines of the same shape and size whereby the letters in the letter display areas of the movable elements cooperate with the letters and punctuation symbols on the base to form a predetermined phrase or sentence.

7 Claims, 3 Drawing Figures

WORD PUZZLE GAME

BACKGROUND OF THE INVENTION

This invention relates to games and puzzles and more particularly to games in which predetermined phrases and sentences unknown to the puzzle solver or game player are formed by taking various letters from a given set of letters and properly juxtaposing them on a puzzle base.

Crossword puzzles and anagram type games are known wherein words or phrases are formed by the puzzle solver or game player by adding one or more letters at a time to a given vertical column or horizontal row array.

Such crossword puzzle games usually require that a definition or synonym of a word be provided for the puzzle solver. The puzzle solver must then determine what word corresponds with the given definition or synonym and then enter that word in the row or column in the puzzle. In anagram type games, the game players usually add one or more letters in sequence in a number of different directions to form words of their choice.

It would be desirable to provide a novel game or puzzle wherein predetermined phrases or complete sentences, initially unknown to the player, could be constructed on the basis of letter and planar shape clues. The degree of difficulty of solving the puzzle, that is, determining the phrase or sentence, could be varied by varying the number of letter clues and planar shape clues initially presented to the player.

SUMMARY OF THE INVENTION

The present invention contemplates a method and apparatus for playing a game or solving a puzzle which can be played on a sheet of paper or which can be played with more complicated apparatus having movable pieces or elements.

In the preferred form of the invention, the game or puzzle comprises a puzzle base which has printed thereon a plurality of rows of language symbols at fixed locations in each row. The language symbols are typically letters and punctuation marks in the desired language. Located in fixed positions among the language symbols on the puzzle base are a plurality of specifically shaped figures or template outlines. The template outlines have various planar shapes and sizes and can include squares, rectangles, L-shaped planar figures and T-shaped planar figures. The template outlines are positioned in at least one of the rows. Some of the template outlines, such as the rectangular and L-shaped template outlines, may occupy positions in two or more adjacent rows.

Each template outline further has at least one language symbol receiving area, which, in the preferred embodiment, is square shaped. All language symbol receiving areas are preferably identical in size and shape.

A set of a plurality of planar figures or elements is provided in a region displaced from the puzzle base to allow the game player to observe both the planar figures and the puzzle base together. Various ones of the planar figures or elements have the same shapes and sizes as various ones of the template outlines. The planar figures may be separate, movable elements or may be printed on a sheet of paper or other material in fixed positions adjacent the puzzle base. In any case, each planar figure has at least one language symbol display area showing a language symbol therein. Each of the language symbol areas of all of the planar figures or elements corresponds with a predetermined language symbol receiving area of the template outlines and is identical in size and shape with the corresponding language symbol receiving area. As in the case of the language symbols in fixed locations in the rows on the puzzle base, the language symbols on the planar figures or elements typically consist of letters and punctuation marks in a particular language.

The language symbols and template outlines that are in fixed locations on the puzzle base are arranged in a predetermined manner to form a predetermined intelligible collocation, such as a phrase or sentence, when the proper language symbols from the set of planar figures or elements are reproduced in a predetermined manner on the appropriate corresponding template outline language symbol receiving areas.

If the planar figures are movable elements, the puzzle can be solved or the game can be played by physically moving an appropriate element and properly superimposing it in registry on a corresponding template outline of the same shape and size. If the planar figures are merely printed on a sheet of material or paper adjacent the puzzle base, the player of the game or solver of the puzzle can reproduce the language symbols from the language symbol display areas, as by writing, in the appropriate corresponding language symbol receiving areas on the template outlines on the puzzle base.

In any case, when all of the language symbols have been physically superimposed on, or reproduced in, the proper language symbol receiving areas of the template outlines, the language symbols from the display areas cooperate with the fixed location language symbols on the puzzle base to form the predetermined intelligible collocation of language symbols, such as a phrase or sentence.

Numerous other advantages and features of the present invention will become readily apparent from the following detailed description of the invention and of embodiments thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
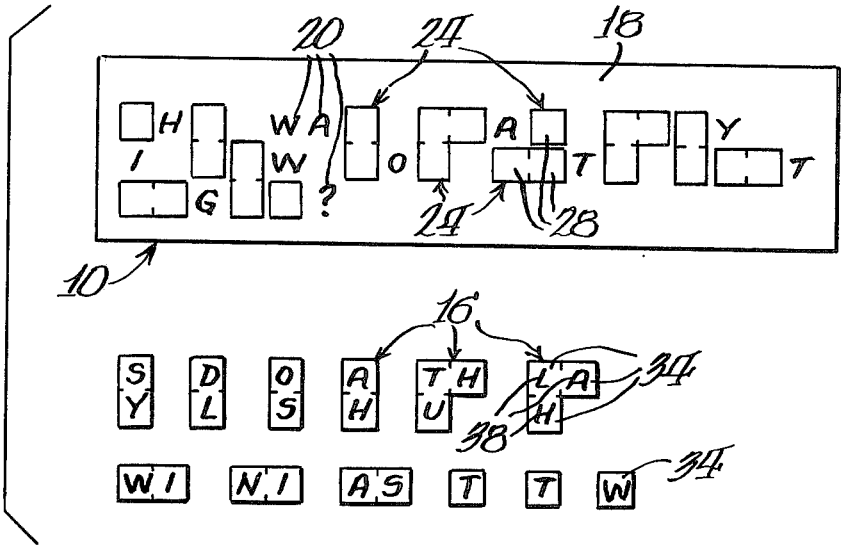
FIG. 1 is an illustration of the puzzle game of the present invention in the unsolved or unassembled form.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to an embodiment, and one modification thereof, which are simple and straightforward.

In the following description, two digit numerals are used to refer to the embodiment illustrated in FIGS. 1 and 2 and three digit numerals in the 100 series are used to refer to the embodiment illustrated in FIG. 3. The same last two digits in each numeral designate identical elements in the two embodiments.

Figure 2:
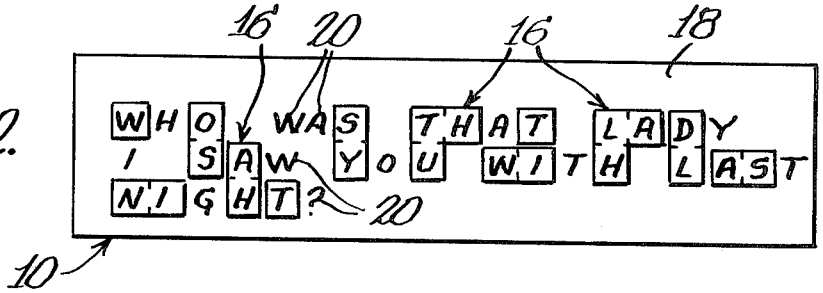
FIG. 2 is an illustration of the puzzle game of FIG. 1 as solved or assembled.

The puzzle game embodying the present invention is illustrated with respect to a specific language example in FIG. 1. The puzzle is illustrated in FIG. 1 in the unsolved or unassembled condition. This is the condition in which it would normally be first encountered by the puzzle solver or game player.

The game or puzzle consists of two basic portions, a puzzle or game base 10 and a set of a plurality of elements 16 which are displaced from the game or puzzle base 10 to allow the game player or puzzle solver to observe both the elements 16 and the game base 10 together.

The puzzle base 10 may include a sheet of paper or other suitable material 18 on which appear (1) at least one row of language symbols 20, such as letters and punctuation, at fixed locations in the rows and (2) a plurality of template outlines 24 of various planar shapes and sizes. The template outlines 24 are located in fixed positions among the language symbols or letters 20 on the game base 10.

Typically, both the letters 20 and the template outlines 24 are printed on the sheet 18. However, the language symbols 20 and template outlines 24 may be three dimensional elements suitably secured to the sheet 18. The sheet 18 may be a flexible piece of paper or plastic or may be a rigid structure, such as cardboard or wood, or may be any other suitable material.

Each template outline 24 has at least one language symbol receiving area 28 therein. In the example illustrated, the language symbol receiving areas 28 are identically sized squares. The language symbol receiving areas may, if desired, be any other suitable shape. Some of the template outlines 24 contain one language symbol receiving area 28. Other template outlines 24 contain three language symbol receiving areas 28. The template outlines 24 may have any suitable shapes, including polygonal, such as squares, rectangles, L-shapes, T-shapes, and any combinations thereof, as well as obliquely angled and curvilinear shapes.

As illustrated in FIG. 1, the language symbols 20 and template outlines 24 form three horizontal rows with a number of the template outlines 28 extending between, and occupying positions in, two adjacent rows. Further, there are blank spaces between (1) some adjacent template outlines 24 and (2) some language symbols 20 and template outlines 24.

The language symbols 20 are chosen and initially fixed in position along with the template outlines 24 by the manufacturer of the game so that a predetermined phrase or sentence is formed when appropriate other language symbols or letters are placed within the language symbol receiving areas 28.

The elements 16 may be separate and physically movable pieces or they may be merely printed on a suitable member, such as on the paper on which the puzzle base 10 may be printed. Preferably, each element 16 is a generally planar figure having the same shape and size as at least one of the template outlines 24 on the puzzle base 10. However, to increase the degree of difficulty of the game, elements 16 having shapes not corresponding to any of the template outlines 24 may be provided.

Each element 16 has at least one language symbol letter display area 34 in which is displayed one language symbol or letter 38.

If the elements 16 are individual, movable pieces, it is seen that they can be superimposed in registry on various corresponding template outlines 24. By proper arrangement of the elements 16 on the template outlines 24, the predetermined phrase or sentence can be formed. For the puzzle game illustrated in FIG. 1, the correct arrangement of the elements 16 on the puzzle base 10 is illustrated in FIG. 2. The completed sentence formed by the proper solution of the puzzle game is "Who was that lady I saw you with last night?"

If the elements 16 are not separate, movable pieces and are instead printed directly on the sheet 18 adjacent the puzzle game base 10, the game can be played, or the puzzle solved, by reproducing, as by writing, the language symbols 38 in the appropriate language symbol receiving areas 28 of the template outlines 24. Such an embodiment of the puzzle game of the present invention would be used in newspapers or magazines wherein the puzzle base 10 and the plurality of elements 16 would be printed on a portion of a single page of a newspaper or magazine substantially as shown in FIG. 1.

Figure 3:
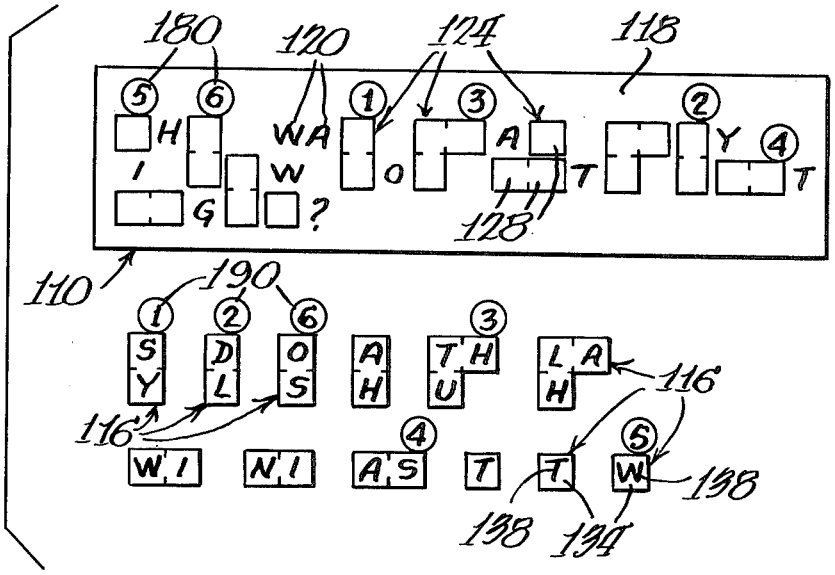
FIG. 3 is an illustration similar to FIG. 1 but showing a modification of the puzzle game of FIG. 1.

A modification of the embodiment of the puzzle game of the present invention illustrated in FIG. 1 is shown in FIG. 3. The constituent elements of the puzzle game shown in FIG. 3 are the same as that for the first embodiment in FIG. 1 and the numerals designating those elements consist of three digit numerals in the 100 series with the last two digits of each numeral being the same as the two digits of the numeral for the corresponding constituent element of the first embodiment illustrated in FIG. 1.

In the modified embodiment illustrated in FIG. 3, the degree of difficulty of the puzzle game is reduced by providing a first set of separate identification indicia 180, such as circled numerals 1 through 6, associated with some number of the template outlines 124. A second set of identification indicia 190, identical to the first set (circled numerals 1 through 6), are associated with corresponding elements 116. Thus, a game player or puzzle solver can easily associate an element 116 having an identification indicia 190 with the proper template outline 124 which has the same identification indicia 180. The number of identification indicia can be increased or decreased depending on whether it is desired to increase or decrease the degree of difficulty of the puzzle game.

Although for the embodiments illustrated a complete sentence in the English language was used, it is possible to apply the present puzzle game invention to any literary works and also to other languages, and to other intelligible collocations of language symbols, such as mathematical formulae, music and dance notations, etc.

The above detailed description has been given for ease of understanding only. No unnecessary limitations are to be understood therefrom, as modifications will be obvious to those skilled in the art.

What is claimed is:

1. A puzzle to be solved to form a predetermined intelligible collocation of language symbols, said puzzle comprising:

a puzzle base, said puzzle base having at least one row of language symbols at fixed locations in each row, said symbols being adapted to be read seriatim from one end to the other of each said row, said base further having a plurality of template outlines of various planar shapes and sizes, said template outlines located in fixed positions among the language symbols on said puzzle base and a plurality of movable elements, various ones of said movable elements corresponding in shape and size to various ones of said template outlines and adapted to be superimposed in registry thereon, at least one of said movable elements further having at least one language symbol display area presenting a language symbol therein, each said language symbol area of all said movable elements being indentical in size and shape whereby, when all of said movable elements are arranged in predetermined locations upon said puzzle base and properly superimposed in registry on said template outlines of the same shape and size, the language symbols in said language symbol display areas on said movable elements cooperate with the language symbols on said puzzle base to form said predetermined intelligible collocation of language symbols when read seriatim from one end to the other of each said row.

2. The puzzle in accordance with claim 1 in which said language symbols comprise at least one of letters and punctuation marks.

3. The puzzle in accordance with claim 1 in which at least one of said template outlines extends into at least two adjacent rows.

4. The puzzle in accordance with claim 1 in which a first set of separate identification indicia are associated with some of said template outlines and in which a second set of identification indicia identical to said first set are associated with corresponding movable elements.

5. A puzzle to be solved to form a predetermined phrase or sentence, said puzzle comprising:

a puzzle base, said puzzle base having a plurality of parallel rows of letters and punctuation symbols at fixed locations in said rows, said symbols being adapted to be read seriatim from one end to the other of each said row with said rows being read seriatim, said base further having a plurality of template outlines of various planar shapes and sizes, said template outlines located in fixed positions among the letters and punctuation symbols on said puzzle base, each said template outline having at least one letter receiving area therein and a plurality of movable elements, various ones of said movable elements corresponding in shape and size to various ones of said template outlines and adapted to be superimposed in registry thereon, each of said movable elements further having at least one letter display area presenting one of said letters therein, each said letter display area of all said movable elements corresponding with one of said template outline letter receiving areas and being identical in size and shape whereby, when all of said movable elements are arranged in predetermined locations upon said puzzle base and properly superimposed in registry on said template outlines of the same shape and size, the letters in said letter display areas of said movable elements cooperate with the letters and punctuation on said puzzle base to form said predetermined phrase or sentence when read seriatim from one end to the other of each said row with said rows being read seriatim.

6. A puzzle to be solved to form a predetermined intelligible collocation of language symbols, said puzzle comprising:

a puzzle base, said puzzle base having at least one row of language symbols at fixed locations in each row, said symbols being adapted to be read seriatim from one end to the other of each said row, said base further having a plurality of template outlines of various planar shapes and sizes, said template outlines located in fixed positions among the language symbols on said puzzle base, said template outlines each having at least one language symbol receiving area therein and a plurality of planar figures displaced from said puzzle base to allow observation of said planar figures and puzzle base together, various ones of said planar figures corresponding in shape and size to various ones of said template outlines, at least one of said planar figures further having at least one language symbol display area presenting a language symbol therein, each said language symbol display area of all said planar figures corresponding with one of said template outline language symbol receiving areas and being identical in size and shape whereby the particular language symbols from each of said language symbol display areas may be reproduced in the corresponding language symbol receiving areas of said template outlines to form said predetermined intelligible collocation of language symbols when read seriatim from one end to the other of each said row.

7. A method of playing a game to form a predetermined intelligible collocation of language symbols, said method comprising the steps of:

providing a game base, said game base having at least one row of language symbols at fixed locations in the row, said symbols being adapted to be read seriatim from one end to the other of each said row, said base further having a plurality of template outlines of various planar shapes and sizes, said template outlines located in fixed positions among said language symbols on said game base, each said template outline further having at least one language symbol receiving area therein;

providing a plurality of elements displaced from said game base to allow observation of said elements and game base together, various ones of said elements corresponding in shape and size to various ones of said template outlines at least one of said elements further having at least one language symbol display area presenting one of said language symbols therein, each of said language symbol display areas of all said elements corresponding with one of said template outline language symbol receiving areas and being identical in size and shape; and reproducing the particular language symbols from each of said language symbol display areas in the corresponding language symbol receiving areas of said template outlines whereby said language symbols so reproduced on said template outlines cooperate with the fixed location language symbols on said game base to form said predetermined intelligible collocation of language symbols when read seriatim from one end to the other of each said row.

* * * * *